US012151840B2

(12) United States Patent
Tan

(10) Patent No.: US 12,151,840 B2
(45) Date of Patent: Nov. 26, 2024

(54) AUTOMATED METHOD AND SYSTEM FOR PACKAGING FLEXIBLE ARTICLES

(71) Applicant: AFA Technologies SDN BHD, Melaka (MY)

(72) Inventor: Ching Khang Tan, Sungai Petani (MY)

(73) Assignee: AFA TECHNOLOGIES SDN BHD, Melaka (MY)

( * ) Notice: Subject to any disclaimer, the term of this patent is extended or adjusted under 35 U.S.C. 154(b) by 0 days.

(21) Appl. No.: 17/918,232

(22) PCT Filed: Oct. 27, 2021

(86) PCT No.: PCT/CN2021/126826
§ 371 (c)(1),
(2) Date: Oct. 11, 2022

(87) PCT Pub. No.: WO2022/257333
PCT Pub. Date: Dec. 15, 2022

(65) Prior Publication Data

US 2024/0101290 A1 Mar. 28, 2024

(30) Foreign Application Priority Data

Jun. 10, 2021 (MY) ..... 2021003212

(51) Int. Cl.
*B65B 5/06* (2006.01)
*B65B 7/20* (2006.01)
(Continued)

(52) U.S. Cl.
CPC ..... *B65B 5/06* (2013.01); *B65B 7/20* (2013.01); *B65B 25/20* (2013.01); *B65B 35/30* (2013.01)

(58) Field of Classification Search
CPC ..... B65B 5/06; B65B 7/20
See application file for complete search history.

(56) References Cited

U.S. PATENT DOCUMENTS 2,909,874 A * 10/1959 Barr ..... B65B 43/265 53/566
2,923,112 A * 2/1960 Harker ..... B65B 7/20 53/376.5

(Continued)

FOREIGN PATENT DOCUMENTS

CN 202728596 2/2013
CN 208053757 11/2018

(Continued)

OTHER PUBLICATIONS

International Search Report—PCT/CN2021/126826 dated Mar. 10, 2022.

(Continued)

*Primary Examiner* — Lucas E. A. Palmer
(74) *Attorney, Agent, or Firm* — CANTOR COLBURN LLP

(57) ABSTRACT

An automated method and system for packaging a stack of flexible articles are disclosed. The method comprises: loading, by a pair of end effectors, the stack of flexible articles into an erected box having a first open end and a second open end, leaving a first gap therebetween; moving, by a first flap closing mechanism, the flap of the first open end from the open configuration to the closed configuration; pushing, by a pushing mechanism, the stack of flexible articles towards the first gap, thereby forming a second gap between the second open end and the stack of flexible articles; and moving, by a second flap closing mechanism, the flap of the second open end from the open configuration to the closed configuration.

14 Claims, 7 Drawing Sheets

(51) Int. Cl.
*B65B 25/20* (2006.01)
*B65B 35/30* (2006.01)

(56) References Cited

U.S. PATENT DOCUMENTS 3,269,091 A * 8/1966 Roy ..... B65B 63/022 53/526
3,678,649 A * 7/1972 Clancy ..... B65B 63/02 53/529
3,805,482 A * 4/1974 O'Shea ..... B65B 25/145 53/120
3,919,827 A * 11/1975 Larson ..... B65B 25/145 53/473
4,526,564 A * 7/1985 Hughes ..... B31B 50/00 493/453
4,751,807 A * 6/1988 Couturier ..... B65B 63/026 53/429
5,115,625 A * 5/1992 Barbulesco ..... B65B 7/20 53/284
5,175,976 A * 1/1993 Petry ..... B65B 39/12 53/566
5,185,984 A * 2/1993 Tisma ..... B65B 59/001 53/566
5,388,389 A * 2/1995 Tisma ..... B65G 17/36 53/566
6,202,392 B1 * 3/2001 Greenwell ..... B65B 25/141 53/566
6,308,502 B1 * 10/2001 Olson ..... B65B 35/405 53/252
7,073,310 B1 * 7/2006 Long ..... B65B 25/145 53/566
7,320,203 B2 * 1/2008 Monti ..... B29C 48/903 53/458
7,543,423 B2 * 6/2009 Long ..... B65B 25/145 53/247
9,309,017 B2 * 4/2016 Langen ..... B65B 43/145
10,815,020 B2 * 10/2020 Castellari ..... B31B 50/024
2015/0158611 A1 * 6/2015 Kalany ..... B65G 47/26 53/531
2018/0222608 A1 * 8/2018 Hutter ..... B65B 5/024
2019/0263547 A1 * 8/2019 Tatsukawa ..... B65B 7/2864
2019/0322066 A1 * 10/2019 Engelhardt ..... B65B 5/061
2022/0340346 A1 * 10/2022 Yoshida ..... B65D 71/063
2023/0227190 A1 * 7/2023 Tanaka ..... B65B 43/10 53/285

FOREIGN PATENT DOCUMENTS

CN 211618333 10/2020
CN 112623356 4/2021
GB 1280760 7/1972
WO 2019221594 11/2019

OTHER PUBLICATIONS

PCT Written Opinion—PCT/CN2021/126826 issued on Mar. 10, 2022, citing CN 208053757.
Indian Office Action—Indian Application No. P00202211349 issued on Jan. 29, 2024, citing CN208053757U, CN211618333U, CN112623356A, GB1280760A, and WO2019221594A1.

* cited by examiner

AUTOMATED METHOD AND SYSTEM FOR PACKAGING FLEXIBLE ARTICLES

CROSS-REFERENCE TO RELATED APPLICATION

The present application claims priority of patent application No. PI2021003212, filed on Jun. 10, 2021. The entire disclosure of the above application is incorporated herein by reference.

FIELD

The present application relates to a method and a system for packaging flexible articles. More particularly, the present application relates to a method and a system for automated packaging of a stack of flexible articles into an erected box without bulging the flexible articles and damaging the erected box.

BACKGROUND

In a gloves production line, gloves which are the finished products are usually packaged into packaging boxes during a product packaging process. Conventionally, this process is done by a human workforce whereby the gloves are stacked manually and inserted into the packaging boxes by workers. This packaging approach requires a large labour intensity and will result in a low glove packaging efficiency as the gloves may be misaligned or disoriented when being loaded into the packaging boxes. As a result, the gloves are bulky and bulgy. Furthermore, the quantity of stacked gloves to be packaged into the packaging boxes can be varied. A large quantity of the stacked gloves is difficult to be inserted into the packaging boxes as the height of the stacked gloves is higher than that of the packaging boxes. The workers need to manually flatten the stacked gloves so that they can fit into the packaging boxes. This manual operation of flattening the stacked gloves is inefficient and not reliable which can result in unflatten stacked gloves. The unflatten stacked gloves can damage the packaging boxes during the product packaging process, thereby producing bulky and bulgy packaging boxes. Other than using the human workforce, many packaging machines have been developed to automatically load the gloves into the packaging boxes. Most of the packaging machines load the gloves into the packaging boxes by pushing the gloves into the boxes through one of its side openings. This pushing operation may cause the packaging boxes to suffer from damages such as tears due to large friction generated between the gloves and any contact surface during its travel into the packaging boxes. Furthermore, the gloves may also be misaligned or disoriented when being pushed into the packaging boxes and this may affect an operation of closing side flaps of the packaging boxes. Due to this, the packaging boxes may look bulky and bulgy.

One exemplary technology of the packaging machines can be referenced from China Patent Publication No. CN202728596U disclosing a device for loading finished gloves into packaging boxes, which comprises a glove transition box installed in a transition box bracket for containing the finished gloves, wherein one end of the transition box bracket is provided with an outer guide tail while the other end is provided with a transition box driving mechanism and a glove block driving mechanism. The transition box driving mechanism is configured to push the glove transition box into the packaging boxes and the glove block driving mechanism is configured to block the gloves so that they remain in the packaging boxes. This packaging machine involves the operation of pushing the gloves into the packaging boxes. When the gloves are pushed into the packaging boxes, the packaging boxes may be torn due to the friction generated with any contact surface during its travel into the packaging boxes. Moreover, the gloves may be messy and bulky within the packaging boxes which may cause difficulties in closing the flaps of the packaging boxes. As a result, the packaging boxes obtained are bulky and bulgy.

Accordingly, it would be desirable to provide a method and a system for automated packaging of a stack of flexible articles into an erected box without bulging the flexible articles and damaging the erected box. The proposed invention provides such a method and a system for packaging the stack of flexible articles that solves the above-mentioned problems.

SUMMARY

In accordance with one aspect of the present application, there is provided an automated method for packaging a stack of flexible articles, wherein the method comprises the steps of loading, by a pair of end effectors, the stack of flexible articles into an erected box having a first open end and a second open end, wherein each open end has at least one flap that is movable between an open configuration where the flap is not covering an opening of the open end and a closed configuration where the flap covers the opening of the open end, whereby the stack of flexible articles is loaded in an offset position away from the first open end, leaving a first gap therebetween, moving, by a first flap closing mechanism, the flap of the first open end from the open configuration to the closed configuration, pushing, by a pushing mechanism, the stack of flexible articles towards the first gap, thereby forming a second gap between the second open end and the stack of flexible articles and moving, by a second flap closing mechanism, the flap of the second open end from the open configuration to the closed configuration, wherein the first and second gaps are configured to prevent the flaps from being obstructed by the stack of flexible articles while closing the flaps.

According to a feature of this aspect of the present application, loading of the stack of flexible articles into the erected box may further include the steps of extending the pair of end effectors from an opposite direction towards each other so that they are in close contact with each other, loading, by a loading means, the stack of flexible articles into a slot formed by the pair of end effectors when they are in close contact, holding, by the pair of end effectors, each opposing end of the stack of the flexible articles and retracting both end effectors in two opposite directions upon loading of the stack of flexible articles within the erected box.

According to another feature of this aspect of the present application, the first flap closing mechanism can be arranged in a horizontal position with respect to a longitudinal axis of the erected box for closing the flaps of the first open end.

According to another feature of this aspect of the present application, the automated method may further comprise the step of re-orientating, by a flipping mechanism, the erected box with a closed first end from a horizontal position to an upright position so that the second open end is facing upward to receive a flap closing operation from the second flap closing mechanism that is arranged in a vertical position with respect to the longitudinal axis of the erected box.

According to another feature of this aspect of the present application, the pushing mechanism may include a plate member that is extendable and retractable along the opening of the second open end, configured to engage with the stack of flexible articles within the erected box and push them towards the first gap.

According to another feature of this aspect of the present application, the erected box can be transferred from one mechanism to another mechanism by one or more controlled arm which is configured to clamp and lift the erected box.

According to another feature of this aspect of the present application, the controlled arm may include a gripping member that is movable within predetermined directions and orientations for clamping, lifting and transferring the erected box.

According to another feature of this aspect of the present application, the first and second flap closing mechanisms may include a plurality of push members that are extendable and retractable in their position for closing the flaps, whereby the plurality of push members are arranged in an array along a pathway of a flap closing station.

In accordance with another aspect of the present application, there is provided an automated system for packaging a stack of flexible articles, wherein the system comprises a pair of end effectors for loading the stack of flexible articles into an erected box having a first open end and a second open end, wherein each open end has at least one flap that is movable between an open configuration where the flap is not covering an opening of the open end and a closed configuration where the flap covers the opening of the open end, whereby the stack of flexible articles is loaded in an offset position away from the first open end, leaving a first gap therebetween, a first flap closing mechanism for moving the flap of the first open end from the open configuration to the closed configuration, a pushing mechanism for pushing the stack of flexible articles towards the first gap, thereby forming a second gap between the second open end and the stack of flexible articles and a second flap closing mechanism for moving the flap of the second open end from the open configuration to the closed configuration, wherein the first and second gaps are configured to prevent the flaps from being obstructed by the stack of flexible articles while closing the flaps.

According to a feature of this aspect of the present application, the pair of end effectors can be configured to extend in an opposite direction towards each other so that they are in close contact with each other to form a slot for receiving the stack of flexible articles.

According to another feature of this aspect of the present application, the pair of end effectors can be further configured to hold each opposing end of the stack of the flexible articles and retract in two opposite directions upon loading of the stack of flexible articles within the erected box.

According to another feature of this aspect of the present application, the first flap closing mechanism can be arranged in a horizontal position with respect to a longitudinal axis of the erected box for closing the flaps of the first open end.

According to another feature of this aspect of the present application, the automated system may further comprise a flipping mechanism for re-orientating the erected box with a closed first end from a horizontal position to an upright position so that the second open end is facing upward to receive a flap closing operation from the second flap closing mechanism that is arranged in a vertical position with respect to a longitudinal axis of the erected box.

According to another feature of this aspect of the present application, the pushing mechanism may include a plate member that is extendable and retractable along the opening of the second open end, configured to engage with the stack of flexible articles within the erected box and push them towards the first gap.

According to another feature of this aspect of the present application, the automated system may further comprise one or more controlled arm configured to transfer the erected box from one mechanism to another mechanism.

According to another feature of this aspect of the present application, the controlled arm may include a gripping member that is movable within predetermined directions and orientations for clamping, lifting and transferring the erected box.

According to another feature of this aspect of the present application, the first and second flap closing mechanisms may include a plurality of push members that are extendable and retractable in their position for closing the flaps, whereby the plurality of push members are arranged in an array along a pathway of a flap closing station.

One skilled in the art will readily appreciate that the present application is well adapted to carry out the objects and obtain the ends and advantages mentioned, as well as those inherent therein. The embodiments described herein are not intended as limitations on the scope of the present application.

BRIEF DESCRIPTION OF THE DRAWINGS

For the purpose of facilitating an understanding of the present application, there is illustrated in the accompanying drawing the preferred embodiments from an inspection of which when considered in connection with the following description, the present application, its construction and operation and many of its advantages would be readily understood and appreciated.

DETAILED DESCRIPTION

The present application will now be described in greater detail, by way of example, with reference to the drawings.

Figure 1:
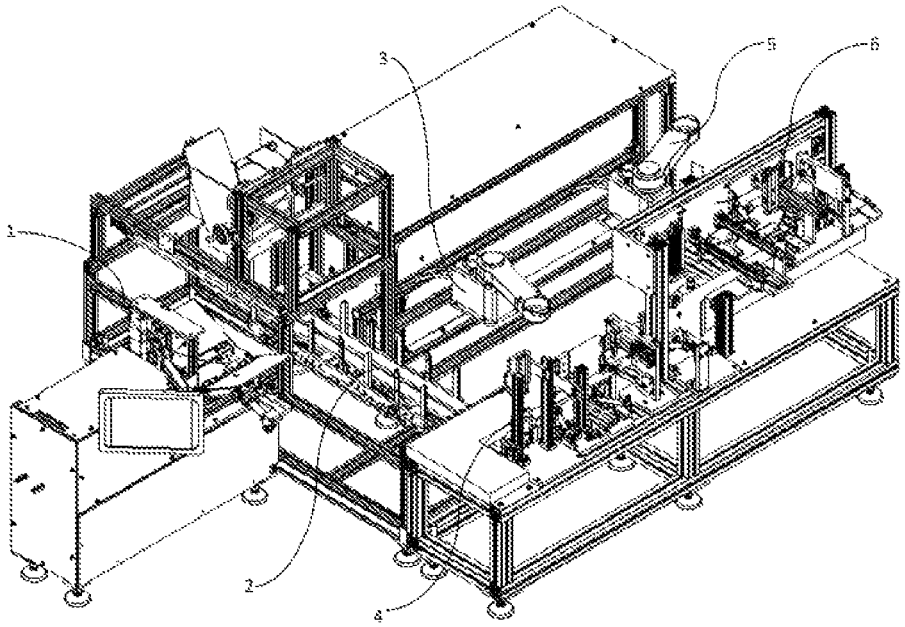
FIG. 1 is a perspective view of a packaging system.
Figure 2:
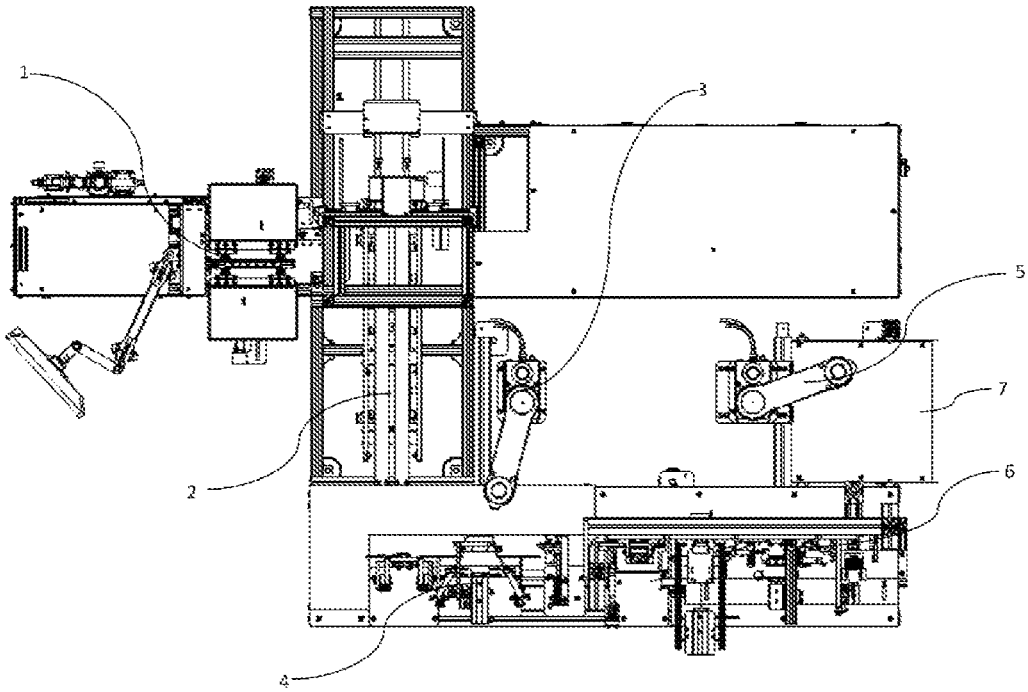
FIG. 2 is a top view of the packaging system.
Figure 3:
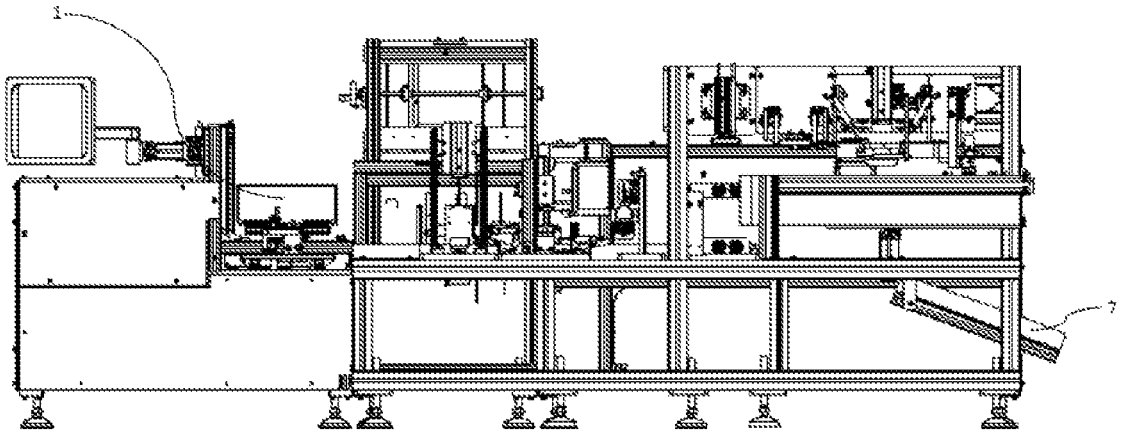
FIG. 3 is a side view of the packaging system.

FIGS. 1 to 3 illustrate a packaging system for automatically packaging a stack of flexible articles 200 into an erected box 100. The erected box 100 mentioned herein preferably refers to a box that is erected from a box blank.

The box blank can be a flat sheet of a board that has been cut, scored and slotted. The box blank may be made from any suitable material such as paper, plastic or in combination thereof. The box blank may be erected manually or automatically by a machine to form the erected box 100. The erected box 100 has a first open end 101 and a second open end 102, wherein each open end 101, 102 comprises at least one flap 103, 104, 105, 106, 107, 108 that is movable between an open configuration where the flap 103, 104, 105, 106, 107, 108 is not covering an opening of the open end 101, 102 and a closed configuration where the flap 103, 104, 105, 106, 107, 108 covers the opening of the open end 101, 102. By way of example, the flexible article 200 is preferably a glove, including but not limited to a surgical glove, a latex glove, a nitrile glove, a neoprene glove, a polyvinylchloride glove or any combination thereof.

The packaging system generally comprises a pair of end effectors 1 configured to load the stack of flexible articles 200 into the erected box 100, a first flap closing mechanism 4 configured to seal the first open end 101 by moving the flap 103, 104, 105 from the open configuration to the closed configuration, and a second flap closing mechanism 6 configured to seal the second open end 102 by moving the flap 106, 107, 108 from the open configuration to the closed configuration. There is also provided a collecting station 7 configured to receive sealed erected box 100. The collecting station 7 preferably includes a surface that is tilted at a predetermined angle in such a way that the sealed erected box 100 is slidable on the surface. Additionally, the packaging system further comprises one or more controlled arms 3, 5 configured to transfer the erected box 100 from one mechanism to another mechanism. A conveying track 2 is provided to transfer the erected box 100 from an erecting station to a loading station and a flap closing station.

Figure 4A:
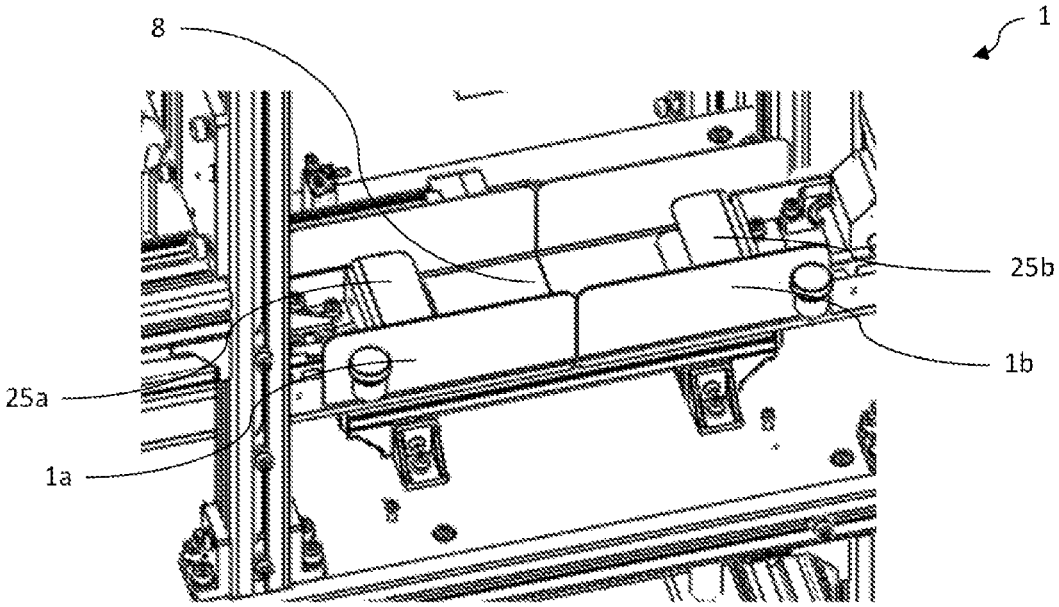
FIG. 4*a*-4*c* is a diagram illustrating a pair of end effectors in a loading station of the packaging system.
Figure 4B:
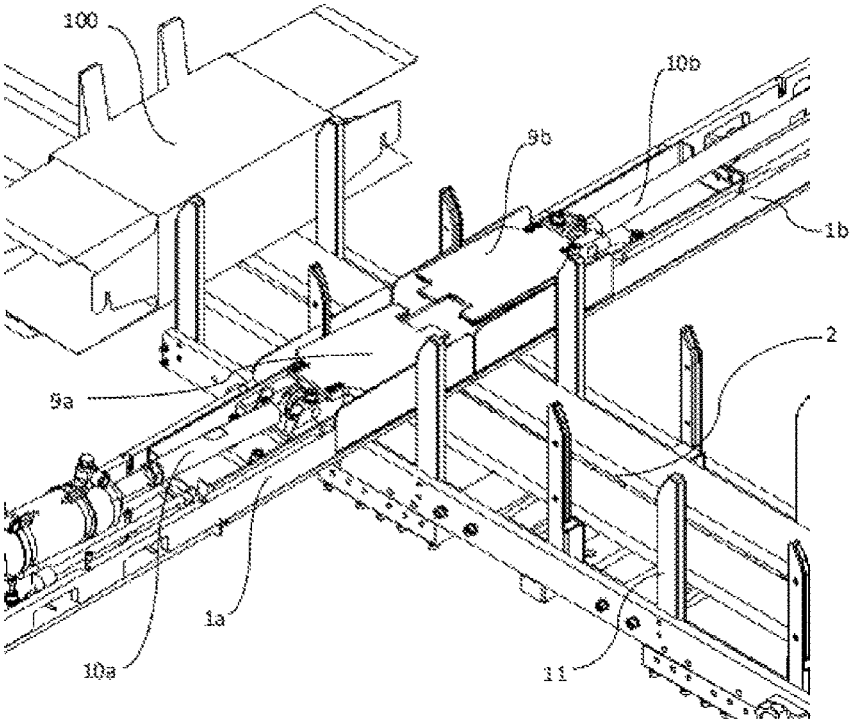
Figure 6:
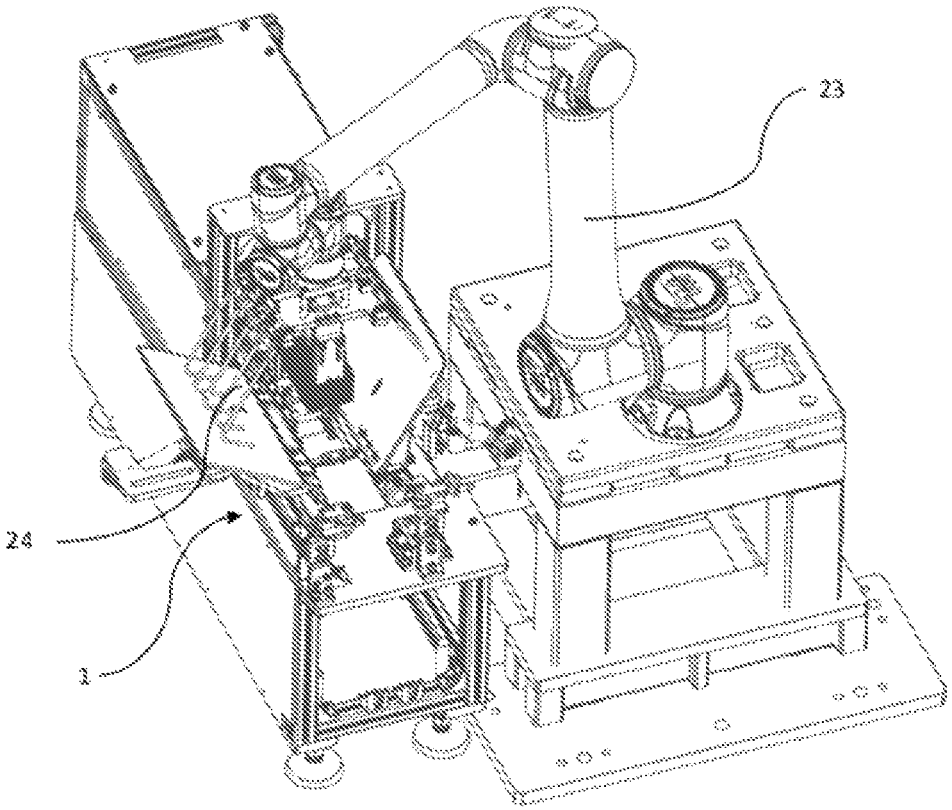
FIG. 6 is diagram illustrating a process of loading the stack of flexible articles by a robotic arm in the loading station of the packaging system.

Referring to FIGS. 4*a* to 4*b*, the pair of end effectors 1 in the loading station is illustrated. FIG. 4*a* shows the pair of end effectors 1 that are in close contact. In one exemplary embodiment, a first end effector 1*a* and a second end effector 1*b* are initially arranged opposite to one another. When a loading operation is in progress, the first and second end effectors 1*a*, 1*b* extend from an opposite direction towards each other so that they are in contact with each other for holding the stack of flexible articles 200. Preferably, one end of each end effector 1*a*, 1*b* is provided with a bracket whereby when both two brackets of the end effectors 1*a*, 1*b* are in contact with each other, a slot 8 is formed which is configured to receive the stack of flexible articles 200 loaded by a user or a machine which preferably is in a form of a robotic arm 23, as shown in FIG. 6. The robotic arm 23 may comprise a pair of grippers 24 configured to hold the stack of flexible articles 200 and load them onto the slot 8 automatically.

Referring to FIG. 4*b*, each end effector 1*a*, 1*b* further comprises a plate member 9*a*, 9*b* configured to engage with one end of the stack of flexible articles 200 upon loading of the stack of flexible articles 200 into the slot 8. Preferably, each plate member 9*a*, 9*b* is connected to an elongate rod 10*a*, 10*b* which is pivotally joined to the other end of the end effector 1*a*, 1*b*. Each elongate rod 10*a*, 10*b* is movable between a direction towards its respective bracket and a direction away from its respective bracket in relative to a pivot point at the other end of the end effector 1*a*, 1*b*. After the stack of flexible articles 200 is loaded into the slot 8, each plate member 9*a*, 9*b* is actuated to pivot towards its respective bracket in a way such that each end of the flexible articles 200 is held within the end effectors 1*a*, 1*b*. Preferably, a sensing unit may be provided to automatically actuate the plate members 9*a*, 9*b* to move towards the respective brackets. The sensing unit may be installed at a section of the loading station for checking a loading condition in the slot 8. By way of example, if the slot 8 is loaded with the stack of flexible articles 200, the sensing unit may transmit a signal to a processing unit of the packaging system to actuate the plate members 9*a*, 9*b* to hold the ends of the stack of flexible articles 200. The actuation of the plate members 9*a*, 9*b* can also be facilitated by the user by pressing a physical or a virtual control button.

Figure 4C:
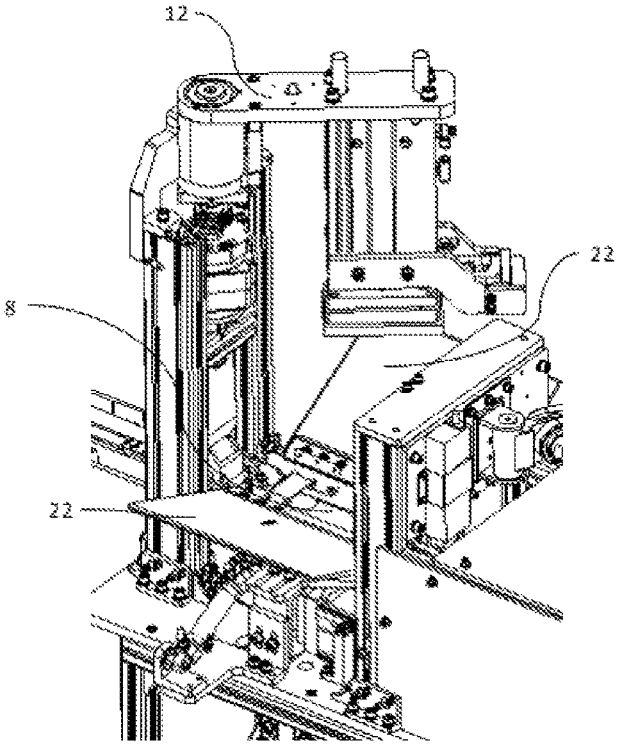

Referring to FIG. 4*c*, the packaging system further comprises a compression mechanism 12 configured to compress the stack of flexible articles 200 upon being loaded in the slot 8 and held by the pair of end effectors 1*a*, 1*b* to ensure that the stack of flexible articles 200 completely enters into the slot 8 during the loading operation. Without this compression operation, some flexible articles 200 may be hanging loose on edges of the slot 8 which can cause jamming of the pair of end effectors 1*a*, 1*b* during its travel into the erected box 100. Additionally, the packaging system comprises a pair of plate members 22, each is arranged at one side of the slot 8 configured to form a vertical channel for the compression mechanism 12 during the compression operation to prevent the stack of flexible articles 200 from escaping out from the slot 8 and to ensure that they are completely in the slot 8. The pair of plate members 22 are initially rested in a horizontal position. After the stack of flexible articles 200 is loaded into the slot 8, the pair of plate members 22 are actuated to move to a vertical position, thereby forming the vertical channel that surrounds the slot 8. Furthermore, the compression mechanism 12 is configured to discharge air from the stack of flexible articles 200. Preferably, the compression mechanism 9 includes a body that is rotatable between predetermined directions having a pushing member that is extendable and retractable in a perpendicular direction with respect to a longitudinal surface of the stack of flexible articles 200. The compression mechanism 12 may be also configured to compress the stack of flexible articles 200 up to a predetermined thickness so that they can fit into the erected box 100.

Figure 5:
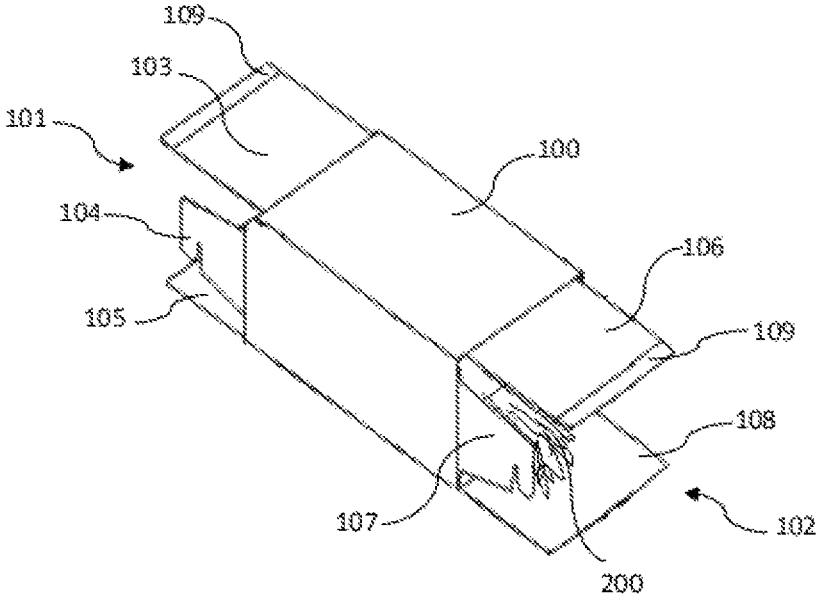
FIG. 5 is diagram illustrating a stack of flexible articles positioned in an offset position within an erected box in an interlock tucking type.

Referring back to FIG. 4*b*, the erected box 100 is transferred from the erecting station by the conveying track 2. Preferably, the conveyor track 2 is arranged perpendicularly to the pair of end effectors 1*a*, 1*b*. The conveying track 2 comprises a plurality sets of vertically extended flanges 11, each set having four vertically extended flanges 11 configured to hold the erected box 100 at its erected position. Each set of the vertically extended flanges 11 is guided to be in a parallel direction with the pair of end effectors 1*a*, 1*b* at a time to form a travel pathway for the pair of end effectors 1*a*, 1*b* in such a way that the second end effector 1*b* is capable of extending across the erected box 100 through the first and second open ends 101, 102 to be in close contact with the first end effector 1*a*. The pair of end effectors 1*a*, 1*b* that are holding each opposing end of the stack of flexible articles 200 are then actuated to travel into the erected box 100 on the conveyor track 2 for loading the stack of flexible articles 200 into the erected box 100. In one preferred embodiment, the stack of flexible articles 200 is loaded in the erected box 100 in an offset position away from the first open end 101, leaving a first gap between the first open end 101 and the stack of flexible articles 200, as shown in FIG. 5. Preferably, both the end effectors 1*a*, 1*b* retract in two opposite directions upon the loading of the stack of flexible articles 200 within the erected box 100. In one embodiment of the present application, each end effector 1*a*, 1*b* further comprises a stopper 25*a*, 25*b* configured to retain the stack of flexible articles 200 by extending inwards to the stack of flexible articles 200 as the end effectors 1*a*, 1*b* retract away from the erected box 100. Preferably, the stoppers 25*a*, 25*b* may be made from a soft and flexible material, such as, by way of example, Teflon or nylon, and are designed in such a way both stoppers 25*a*, 25*b* will retract in a direction away from the stack of flexible articles 200 as it holds the stack in place. Advantageously, the loading operation prevents the stack of flexible articles 200 and the erected box 100 from experiencing a frictional contact with any surface during the travel of the stack of flexible articles 200 into the erected box 100 and further prevents them from being torn during the loading operation.

In one embodiment of the present application, the loading operation is conducted such that when the stack of flexible articles 200 is held by the pair of end effectors 1*a*, 1*b*, the stack of flexible article 200 is loadable into the erected box 100 whilst maintaining substantially the same distance between both the end effectors 1*a*, 1*b* to prevent bulging of the flexible articles 200 during loading into the erected box 100. In this particular embodiment, the pair of end effectors 1*a*, 1*b* may have a sensing unit that ensures both the end effectors 1*a*, 1*b* are spaced apart at the same distance during its travel along into the erected box 100. By way of example, the sensing unit may be an infrared sensor that detects the distance between both end effectors 1*a*, 1*b*. After the pair of end effectors 1*a*, 1*b* have retracted to a predetermined distance, the stoppers 25*a*, 25*b* will also retract in two opposite directions away from the stack of flexible articles 200.

Figure 7:
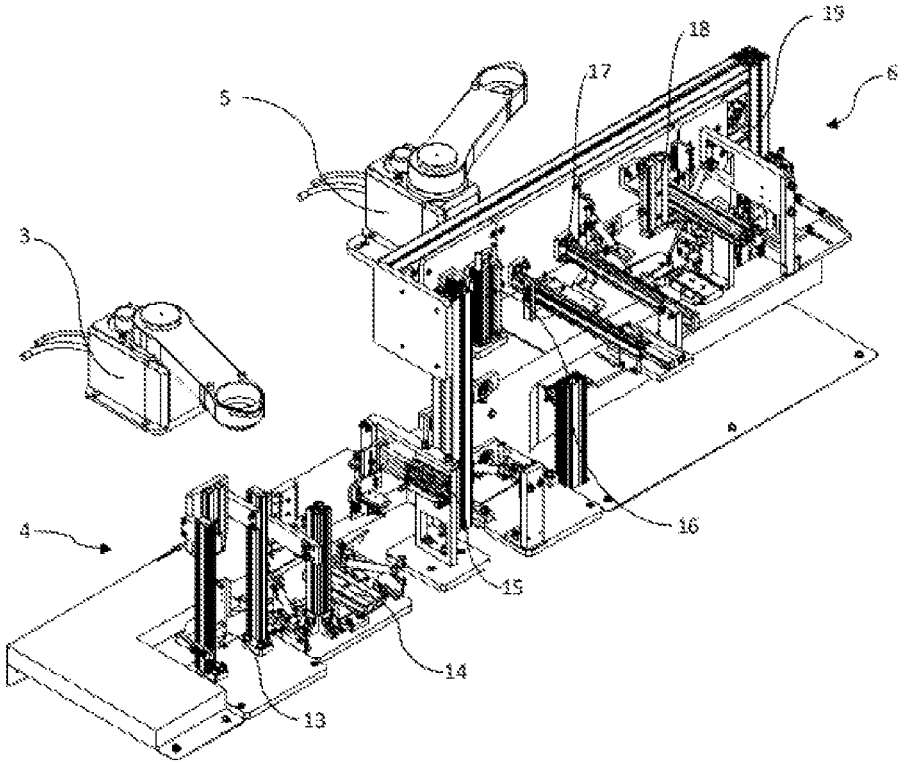
FIG. 7 is diagram illustrating a first flap closing mechanism and a second flap closing mechanism of the packaging system.
Figure 8:
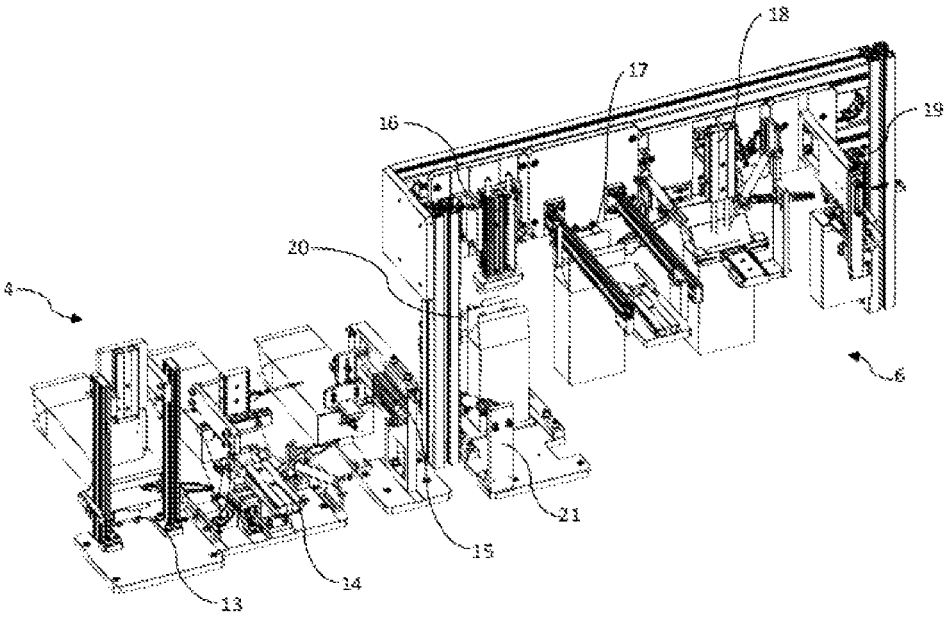
FIG. 8 is diagram illustrating a process of closing flaps of the erected box in the first flap closing mechanism and the second flap closing mechanism of the packaging system.

Referring to FIGS. 7 & 8, a flap closing station is illustrated. The packaging system further comprises a first flap closing mechanism 4 and a second flap closing mechanism 6 configured to close the flaps 103, 104, 105, 106, 107, 108 of the first and second open ends 101, 102 of the erected box 100 respectively. Preferably, the first open end 101 of the erected box 100 is directed to the first flap closing mechanism 4 for receiving a flap closing operation first. Advantageously, the first gap between the first open end 101 and the stack of flexible articles 200 ensures a smooth flap closing operation as it prevents the flap 103, 104, 105 from being obstructed by the stack of flexible articles 200 when closing the flap 103, 104, 105. Preferably, the first flap closing mechanism 4 is arranged in a horizontal position at the flap closing station with respect to a longitudinal axis of the erected box 100 for closing at least one flap 103, 104, 105 of the first open end 101. Preferably, the second flap closing mechanism 6 is arranged in a vertical position at the flap closing station with respect to the longitudinal axis of the erected box 100 for closing at least one flap 106, 107, 108 of the second open end 102.

In one particular embodiment, each open end 101, 102 of the erected box 100 has more than one flaps, including two inner flaps 104, 107 and two outer flaps 103, 105, 106, 108. Both first and second flap closing mechanisms 4, 6 include a plurality of push members 14, 15, 18, 19 that are extendable and retractable in their positions for closing the flaps 103, 104, 105, 106, 107, 108 whereby the plurality of push members 14, 15, 18, 19 are arranged in an array along a pathway of the flap closing station. By way of example, a first push member 14, 18 of the first and second flap closing mechanisms 4, 6 may comprise two elongate rods connected in a form of a scissor assembly where a distance between both distal ends of the elongate rods is of at least a width of the open end 101, 102, particularly a distance between both the inner flaps 104, 107. The first push members 14, 18 are configured to move along the longitudinal axis of the erected box 100, parallel to the first and second open ends 101, 102 for engaging with the inner flaps 104, 107 and moving them from the open configuration to the closed configuration simultaneously. The first push member 14, 18 of the first and second flap closing mechanisms 4, 6 may further comprise one or more push plates having a flat surface for moving a first outer flap 103, 106 of the open end 101, 102 of the erected box 100 from the open configuration to the closed configuration. Furthermore, a second push member 15, 19 of the first and second flap closing mechanisms 4, 6 which is preferably arranged beside the first push members 14, 18 may comprise one or more push plates having a flat surface for moving a second outer flap 105, 108 of the open end 101, 102 from the open configuration to the closed configuration to fully cover the opening of the first and second open ends 101, 102 of the erected box 100. Additionally, the first outer flap 103, 106 further includes an inwardly folded flap 109 at its end which can be formed by a folding member 13, 17 of the first and second flap closing mechanisms 4, 6, whereby the inwardly folded flap 109 is configured to slip into the erected box 100 when the first outer flap 103, 106 is pushed to the closed configuration.

The packaging system further comprises a flipping mechanism that is arranged in between the first and second flap closing mechanisms 4, 6, configured to re-orient the erected box 100 with a closed first open end 101 from a horizontal position to an upright position so that the second open end 102 is facing upward to receive a flap closing operation from the second flap closing mechanism 6 that is arranged in the vertical position with respect to a longitudinal axis of the erected box 100. Preferably, the flipping mechanism comprises a platform 20 configured to allow the erected box 100 to rest thereon in its horizontal position. The platform 20 can be actuated by an actuator 21 to be lifted up from an initial horizontal position to an upright position which this subsequently flips the erected box 100 that is resting on the platform 20. Additionally, the packaging system further comprises a pushing mechanism 16 that is arranged in a vertical position at the flap closing station with respect to the longitudinal axis of the erected box 100 and is installed after the flipping mechanism and before the second flap closing mechanism 6. The pushing mechanism 16 is configured to push the stack of flexible articles 200 towards the first gap, thereby forming a second gap between the second open end 102 and the stack of the flexible articles 200. Advantageously, this pushing operation by the pushing mechanism 16 is to discharge trapped air from the stack of flexible articles. Furthermore, the second gap ensures a smooth flap closing operation as it prevents the flaps 106, 107, 108 of the second open end 102 from being obstructed by the stack of flexible articles 200 when closing the flaps 106, 107, 108. Preferably, the pushing mechanism 16 includes a plate member that is extendable and retractable in a vertical direction along the opening of the second open end 102, configured to engage with the stack of flexible articles 200 within the erected box 100 and push them towards the first gap to form the second gap.

The packaging system further comprises one or more controlled arms 3, 5 for transferring the erected box 100 loaded with the stack of flexible articles 200 from one mechanism to another mechanism. By way of example, a first controlled arm 3 is configured to clamp and lift the erected box 100 from the conveyor track 2 and direct the first open end 101 of the erected box 100 to the first flap closing mechanism 4 to receive the flap closing operations from each push member 14, 15. Furthermore, the first controlled arm 3 is configured to place the erected box 100 with the closed first open end 101 on the flipping mechanism. A second controlled arm 5 is configured to transfer the re-oriented erected box 100 to the second flap closing mechanism 6 to receive the flap closing operations from each push member 18, 19. Preferably, the controlled arms 3, 5 may include a gripping member that is movable within predetermined directions and orientations for clamping, lifting and transferring the erected box 100. The second controlled arm 5 is further configured to transfer the erected box 100 obtained from the second flap closing mechanism 6 to the collecting station 7.

Figure 9:
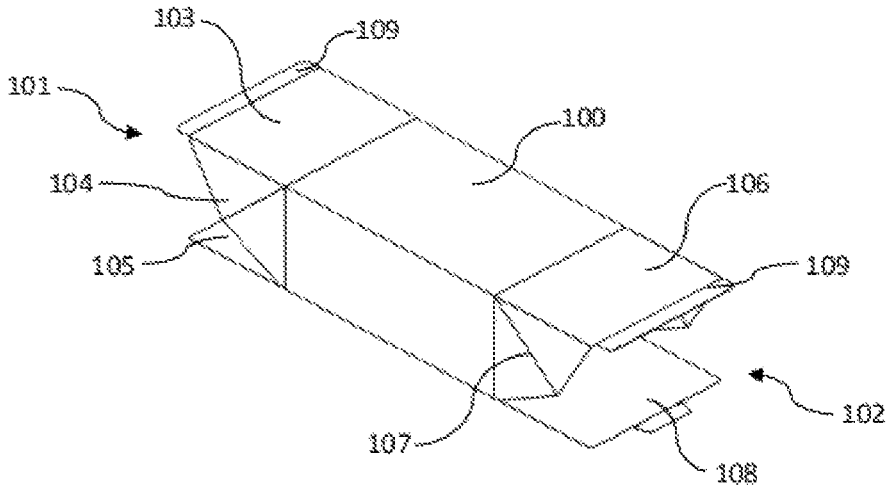
FIG. 9 is diagram illustrating an erected box in a butterfly tucking type.

By way of example, the erected box 100 described herein is in an interlock tucking type, as shown in FIG. 5. It should be understood that the design of the erected box 100 can be easily replaced with other designs such as but not limited to a butterfly tucking type as shown in FIG. 9. The push members 14, 15, 18, 19 of the first flap closing mechanism 4 and the second flap closing mechanism 6 in the flap closing station 7 can be re-designed accordingly to close the flaps 103, 104, 105, 106, 107, 108 of the erected box 100 in the butterfly tucking type. Preferably, the erected box 100 described herein may be with gluing or without gluing.

Figure 10:
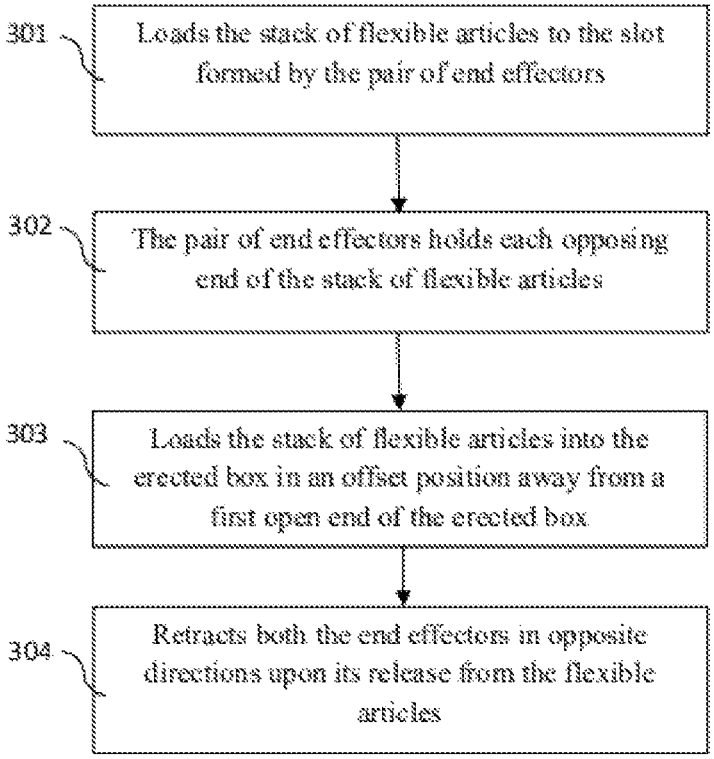
FIG. 10 is a flow chart illustrating a process flow of loading the stack of flexible articles into the erected box.

In a further aspect of the present application, the packaging system can be used for executing a series of steps to package the stack of flexible articles 200 into the erected box 100. Referring to FIG. 10, a process flow of loading the stack of flexible articles 20 into the erected box 100 is illustrated. In step 301, the stack of flexible articles 200 is first loaded by the user or the machine into the slot 8 formed by the pair of end effectors 1*a*, 1*b* which is in close contact. In step 302, after the loading operation is completed, each plate member 9*a*, 9*b* of the pair of end effectors 1*a*, 1*b* is actuated to hold each opposing end of the stack of flexible articles 200 in the slot 8. In step 303, the pair of end effectors 1*a*, 1*b* travels into the erected box 100 to load the stack of flexible articles 200 into the erected box 100 in an offset position away from the first open end 101 of the erected box 100. In step 304, both the end effectors 1*a*, 1*b* are retracted in opposite directions upon loading of the stack of flexible articles 200 within the erected box 100.

Figure 11:
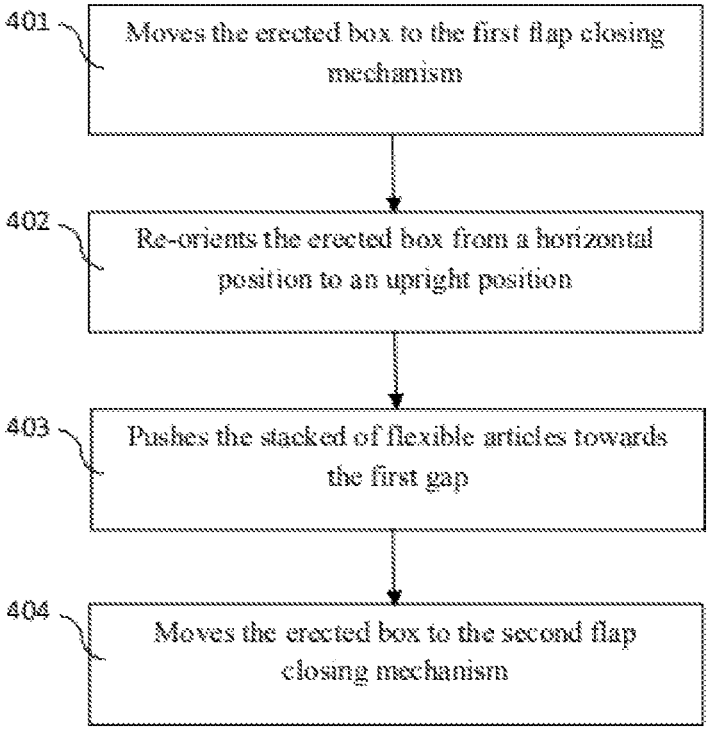
FIG. 11 is a flow chart illustrating a process flow of closing the flaps of the erected box.

Referring to FIG. 11, a process flow of closing the flaps 103, 104, 105, 106, 107, 108 of the erected box 100 is illustrated. In step 401, the first controlled arm 3 lifts the erected box 100 from the conveyor track 2 and moves the first open end 101 of the erected box 100 to the first flap closing mechanism 4 to receive the flap closing operations from the push members 14, 15. Once the first open end 101 is closed, the first controlled arm 3 further places the erected box 100 on the flipping mechanism to re-orient the erected box 100 from its horizontal position to the upright position, as shown in step 402. In step 403, the pushing mechanism 16 is actuated to push the stacked of flexible articles 200 towards the first gap through the opening of the second open end 102. In step 404, the second controlled arm 5 moves the re-oriented erected box 100 to the second flap closing mechanism 6 to receive the flap closing operations from the push members 18, 19.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the present application.

The invention claimed is:

1. An automated method for packaging a stack of flexible articles, the method comprising:

loading, by a pair of end effectors, the stack of flexible articles into an erected box having a first open end and a second open end, wherein each open end has at least one flap that is movable between an open configuration where the flap is not covering an opening of the open end and a closed configuration where the flap covers the opening of the open end, whereby the stack of flexible articles is loaded in an offset position away from the first open end, leaving a first gap therebetween;

moving, by a first flap closing mechanism, the flap of the first open end from the open configuration to the closed configuration;

pushing, by a pushing mechanism, the stack of flexible articles towards the first gap, thereby forming a second gap between the second open end and the stack of flexible articles; and moving, by a second flap closing mechanism, the flap of the second open end from the open configuration to the closed configuration, wherein the first and second gaps are configured to prevent the flaps from being obstructed by the stack of flexible articles while closing the flaps, wherein the loading includes: extending the pair of end effectors from an opposite direction towards each other so that the pair of end effectors are in close contact with each other;

loading, by a loading means, the stack of flexible articles into a slot formed by the pair of end effectors when the pair of end effectors are in close contact;

holding, by the pair of end effectors, each opposing end of the stack of the flexible articles; and retracting both end effectors in two opposite directions upon loading of the stack of flexible articles within the erected box, and wherein each end effector comprises a stopper configured to retain the stack of flexible articles by extending inwards to the stack of flexible articles as the end effectors retract away from the erected box.

2. The automated method according to claim 1, wherein the first flap closing mechanism is arranged in a horizontal position with respect to a longitudinal axis of the erected box for closing the flaps of the first open end.

3. The automated method according to claim 2, further comprising: re-orientating, by a flipping mechanism, the erected box with a closed first open end from a horizontal position to an upright position so that the second open end is facing upward to receive a flap closing operation from the second flap closing mechanism that is arranged in a vertical position with respect to the longitudinal axis of the erected box.

4. The automated method according to claim 1, wherein the pushing mechanism includes a plate member that is extendable and retractable along the opening of the second open end, configured to engage with the stack of flexible articles within the erected box and push them towards the first gap.

5. The automated method according to claim 1, wherein the erected box is transferred from one mechanism to another mechanism by one or more controlled arm which is configured to clamp and lift the erected box.

6. The automated method according to claim 5, wherein the controlled arm includes a gripping member that is movable within predetermined directions and orientations for clamping, lifting and transferring the erected box.

7. The automated method according to claim 1, wherein the first and second flap closing mechanisms include a plurality of push members that are extendable and retractable in their position for closing the flaps, whereby the plurality of push members are arranged in an array along a pathway of a flap closing station.

8. An automated system for packaging a stack of flexible articles, the system comprising:

a pair of end effectors for loading the stack of flexible articles into an erected box having a first open end and a second open end, wherein each open end has at least one flap that is movable between an open configuration where the flap is not covering an opening of the open end and a closed configuration where the flap covers the opening of the open end, whereby the stack of flexible articles is loaded in an offset position away from the first open end, leaving a first gap therebetween;

a first flap closing mechanism for moving the flap of the first open end from the open configuration to the closed configuration;

a pushing mechanism for pushing the stack of flexible articles towards the first gap, thereby forming a second gap between the second open end and the stack of flexible articles; and a second flap closing mechanism for moving the flap of the second open end from the open configuration to the closed configuration, wherein the first and second gaps are configured to prevent the flaps from being obstructed by the stack of flexible articles while closing the flaps, wherein the pair of end effectors is configured to extend in an opposite direction towards each other so that the pair of end effectors are in close contact with each other to form a slot for receiving the stack of flexible articles, wherein the pair of end effectors is further configured to hold each opposing end of the stack of the flexible articles and retract in two opposite directions upon loading of the stack of flexible articles within the erected box, and wherein each end effector further comprises a stopper configured to retain the stack of flexible articles by extending inwards to the stack of flexible articles as the end effectors retract away from the erected box.

9. The automated system according to claim 8, wherein the first flap closing mechanism is arranged in a horizontal position with respect to a longitudinal axis of the erected box for closing the flaps of the first open end.

10. The automated system according to claim 9, further comprising a flipping mechanism for re-orientating the erected box with a closed first open end from a horizontal position to an upright position so that the second open end is facing upward to receive a flap closing operation from the second flap closing mechanism that is arranged in a vertical position with respect to the longitudinal axis of the erected box.

11. The automated system according to claim 8, wherein the pushing mechanism includes a plate member that is extendable and retractable along the opening of the second open end, configured to engage with the stack of flexible articles within the erected box and push them towards the first gap.

12. The automated system according to claim 8, further comprising one or more controlled arm configured to transfer the erected box from one mechanism to another mechanism.

13. The automated system according to claim 12, wherein the controlled arm includes a gripping member that is movable within predetermined directions and orientations for clamping, lifting and transferring the erected box.

14. The automated system according to claim 8, wherein the first and second flap closing mechanisms include a plurality of push members that are extendable and retractable in their position for closing the flaps, whereby the plurality of push members are arranged in an array along a pathway of a flap closing station.

* * * * *